United States Patent [19]

Glucksman

[11] Patent Number: 4,489,233

[45] Date of Patent: Dec. 18, 1984

[54] HAIR ROLLER HEATING UNIT

[76] Inventor: Dov Z. Glucksman, 26 Beacon St., Apt. 9F, Burlington, Mass. 01803

[21] Appl. No.: 567,239

[22] Filed: Dec. 30, 1983

[51] Int. Cl.[3] ..... A45D 4/12; H05B 3/02

[52] U.S. Cl. ..... 219/242; 132/33 R; 219/222; 219/521; 219/523

[58] Field of Search ..... 132/33 R, 33 G, 39; 219/222, 226, 242, 523, 521, 534

[56] References Cited

U.S. PATENT DOCUMENTS

| | | | |
|---|---|---|---|
| 3,415,254 | 12/1968 | Brock et al. | 219/222 X |
| 3,473,005 | 10/1969 | Grandinetti | 219/222 |
| 3,541,302 | 11/1970 | Makino | 219/222 |
| 3,584,632 | 6/1971 | Weidner et al. | 219/222 X |
| 3,600,552 | 8/1971 | Tolmie | 219/242 X |
| 3,610,878 | 10/1971 | Thomas | 219/242 X |
| 3,666,915 | 5/1972 | De Napoli | 219/222 |
| 3,701,882 | 10/1972 | Wada et al. | 219/242 X |
| 3,705,974 | 12/1972 | Nilsson | 219/242 X |
| 3,858,029 | 12/1974 | Walter | 219/222 |
| 4,253,013 | 2/1981 | Mabuchi | 219/242 X |
| 4,298,787 | 11/1981 | Barradas | 219/242 X |

FOREIGN PATENT DOCUMENTS

| | | | |
|---|---|---|---|
| 2104794 | 11/1971 | Fed. Rep. of Germany | 219/242 |

*Primary Examiner*—A. Bartis

*Attorney, Agent, or Firm*—John S. Roberts, Jr.

[57] ABSTRACT

An electrical heating unit of a heating set for hair curling rollers, is composed of two aluminum sheet components carrying together three parallel rows of upstanding heating posts and enclosing between them a resistance heater of the "rope heater" kind. It comprises a main plate of rectangular configuration which contains two lateral parallel rows of hollow heating posts along the long edges of the rectangle and is centrally recessed over its entire length in the shape of a rectangular trough of a depth corresponding to the thickness of the rope heater. The rope heater is positioned in the trough and extends along the four sides of the rectangle, while its ends are attached to a thermostatic switch and a thermo-fuse located in a separate pocket in this trough. A top plate covers the trough in the main plate and is provided with one central row of heating posts which are staggered in relation to the posts of the lateral rows. The top plate is recessed in its center portion by a number of rectangular wells which extend to the bottom of the trough, each well being perforated by a bore which cooperates with a similar bore in the trough. Rivets or screws connect the main plate to the top plate forcefully compressing the rope heater between their surfaces, thus providing good heat conductive contact between the heater and the two plates.

10 Claims, 3 Drawing Figures

HAIR ROLLER HEATING UNIT

MATERIAL INFORMATION DISCLOSURE

The following U.S. patents are considered as prior art: U.S. Pat. Nos. 3,473,005 and 3,858,029.

BACKGROUND OF THE INVENTION

The invention relates to a heating set for hair curling rollers, more especially to the electrical heater unit of the heating set serving to transfer heat from resistance heater means to such rollers.

A hair roller heating set generally comprises a box-shaped container which is readily opened and closed and which houses a given number of hair curling rollers. The rollers are heated while positioned on metal posts which form part of a common electric heater unit inside the casing; the rollers are taken out of the casing one by one and placed in the hair with strands of hair wound around them, thus forming the desired curls or waves of the hair-do. As in all electric heating units, the roller heater is provided with temperature controlling means, such as a thermostatic switch, in order not to overheat the rollers, and with switching and back-up temperature limiting.

In order to attain satisfactory operation of the heating set, it is important that every one of the rollers is heated to the same temperature, and that it is heated as rapidly as possible after having been placed onto its respective post. This requires even distribution of heat over the entire heating unit and effective heat transfer from the electric resistance heater to every post and, likewise, from post to roller.

The known roller heating sets comprise heat transfer units which consist either of die-cast aluminum or zinc bodies, or of pressed and stamped metal sheeting. The conventional die-cast unit generally consists of a flat plate with three rows of upwardly extending posts on its top side and with a plurality of narrow ribs on its underside. The ribs form continuous channels serving to have electrical, metal-sheathed heater inserted therein, and to be bent over the heater after its insertion, so as to provide intimate contact between the plate and the sheathed heater.

These units are comparatively expensive owing to the large weight of zinc or aluminum required for a die-cast body. They heat up slowly, again owing to the large mass of zinc or aluminum which has to be heated initially before heat is transferred to the rollers. They are usually provided with a sheathed resistance heater laid in the channels between the ribs in U-shaped arrangement, a system which makes for unequal heat distribution, although the large mass makes somehow up for it. The penalty, as said before, is slow heating-up and high cost.

The known sheet-metal units generally comprise of a first oblong plate perforated in predetermined locations, and deep-drawn posts fastened in the perforations by swaging, for the purpose of rapid heat transfer. The heating element mostly used in these units consists of a central, oblong mica plate wound with resistance wire and positioned between two outer mica plates serving as electrical insulation. The heating element is positioned underneath the first plate and urged towards its underside by a second, separate bottom plate fastened to the first plate by such known means as rivets or screws. The wire is wound upon the central mica plate in a manner concentrating more wire towards the end portions, thus delivering more heat energy to the posts located at the ends of the plate; this arrangement serves to ensure a more or less even distribution of heat to all posts, whereas with uniform heating of the entire surface the posts at both ends would receive less heat energy than those in the central portion of the plate. However, with three parallel rows of posts, as is the general rule, the center row would be more intensely heated than the lateral rows. Another drawback of the location of the heating element is the loss of heat energy by radiation and convection to and through the bottom plate.

Another drawback of the known sheet metal units is their high cost due to the use of separately fabricated plates and posts and their subsequent assembly and connection by swaging.

A method of heating every post—and likewise every roller—to the same temperature by supplying to each to same heat energy is disclosed in U.S. Pat. No. 3,473,005. In a sheet metal heating unit provided with hollow posts, an insulated resistance wire heater of the kind known as "rope heater" extends underneath the sheet metal plate while entering each post from below and being secured therein close to the post's inner surface by special clamps. Each post contains the same length of rope heater of the same ohmage, and it is evident that not only is an equal amount of heat energy supplied to each post but that an excellent heat transfer to the roller is assured due to the closeness of wire and roller material.

The system appears to be theoretically ideal, but the labor involved in inserting the rope heater into every individual post and in securing it therein, results in a very expensive unit, in addition to the cost of the great length of rope heater required.

It is, therefore, the main object of the present invention to provide an electrical heater unit for a hair curler heating set that is of light weight and can be manufactured at low cost.

It is another object to increase the heating effectiveness by providing a rapid heat transfer from a resistance heater to the rollers and by reducing the heat losses by radiation and convection through the bottom as in conventional heater units.

And it is a final object to provide the same heat energy to every one of the posts in the unit, as far as this is possible.

SUMMARY OF THE INVENTION

The electrical heater unit of the invention is designed for three parallel rows of posts, but the same design may likewise be utilized for two central rows and two lateral rows of posts, however, in the following a three-row unit will be described.

The heater unit comprises two sheet metal components of a high heat conductivity carrying three parallel rows of upstanding hollow heating posts and enclosing between them resistance heater means, viz: a main plate of generally rectangular configuration containing two lateral, parallel rows of posts along the long edges of the rectangle and being centrally recessed in the shape of a substantially rectangular trough of a depth commensurate with the thickness of the resistance heater means, the trough extending between the two rows of lateral posts over substantially the entire length of the plate; a top plate of rectangular configuration provided with a central row of hollow heating posts, commensurate with the trough in the main plate and rigidly attached to the main plate so as to completely cover the rectangular trough; an electric resistance heater in the form of an electrically insulated wire positioned in the trough and physically contacting both the main plate and the top plate.

In a preferred embodiment the central portion of the top plate, between each two posts, is recessed to form shallow wells, each well being perforated by a hole mating with a similar hold in the bottom of the trough of the main plate, serving to forcefully connect the two plates by rivets, screws or the like.

The areas between adjoining posts along the long sides of the main plate are preferably cut away, in order to reduce the amount of material to be heated.

The electric heating means is in the form of a so-called "rope heater" which consists of a fiberglass core helically wound with a fine resistance wire and of an outer woven fiberglass sleeve serving as electrical insulation. The rope heater is laid along the four sides of the rectangular trough close to its edges in such a manner that it is in close proximity to the lateral rows of posts and at a greater distance from the central row of posts, for reasons to be explained further on. The ends of the heater are electrically connected to a thermostatic switch and to a thermo-fuse positioned in the central portion of the trough.

SHORT DESCRIPTION OF THE DRAWINGS

FIG. 1 is a top view of a heater unit of a roller heating set provided with 20 upstanding hollow posts, FIG. 2 is a section along A—A of FIG. 1, and FIG. 3 is a top view of the heater unit of FIG. 1 with the top plate removed, showing the electrical heating means installed in the trough of the main plate.

DESCRIPTION OF THE PREFERRED EMBODIMENT

Figure 1:
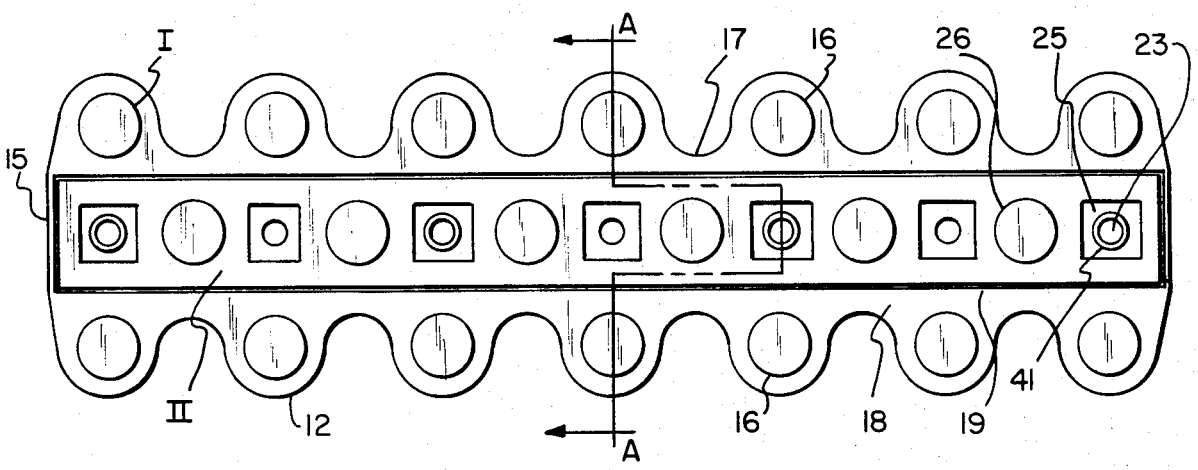
Figure 2:
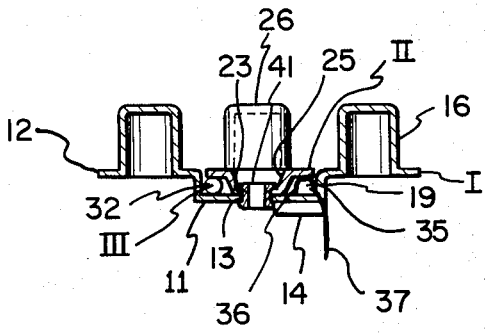
Figure 3:
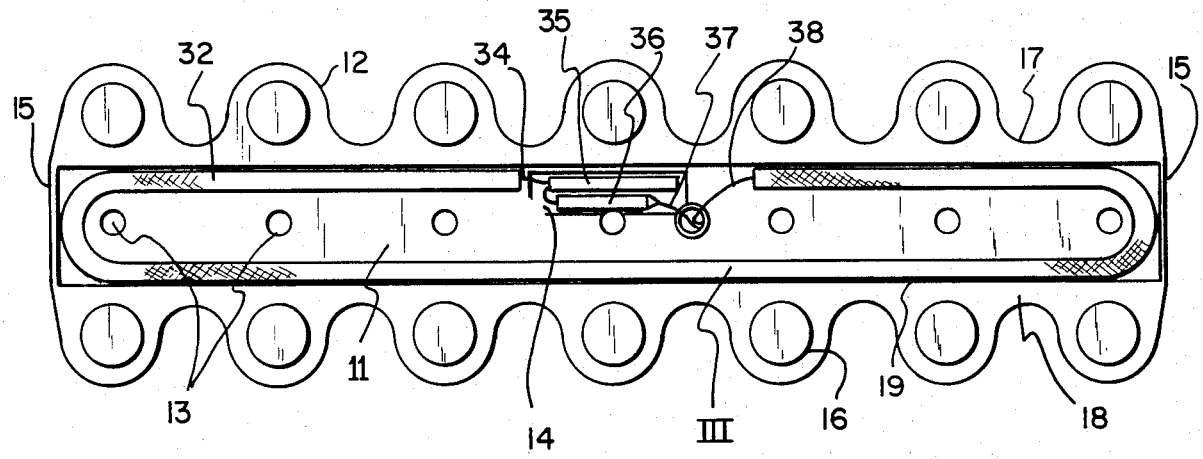

With reference to the drawing a heater unit comprised of a main plate I, a top plate II, both of aluminum sheeting, and electrical heating equipment III. The main plate I is of generally rectangular configuration and comprises seven hollow, upstanding and equally spaced posts 16 along each of its long sides 12 close to the outer edges. The sheet material between every two posts is removed in the shape of rounded cut-outs 17, leaving only narrow portions 18, for the purpose of both reducing the weight of the unit and lessening the mass of unnecessary material to be preheated. The central portion of the plate is recessed in the shape of a shallow trough 11, its bottom being further recessed to form a rectangular pocket 14 which is positioned in its center portion close to one long side of the trough. The trough is bordered on its long sides by walls 19 merging with the lateral plate sides carrying the posts, and on its short sides by two upstanding walls 15. It is perforated along its center line by evenly spaced holes 13 which serve to connect the top plate.

The top plate II is of rectangular plan corresponding to the dimensions of the trough 11 along its top edges. It is provided along its center line with six hollow, upstanding, equally spaced posts 26 similar to the posts 16 of the main plate, the posts of plates I and II being in mutually staggered arrangement. The plate areas between each two posts and on the outside of the first and last post are recessed to form rectangualr wells 25 evenly spaced along the center line and extending in downward direction to the bottom of the trough. Each well is perforated by a hole 23, all holes 23 mating with the holes 13 after assembly of the top plate with the main plate, whereby the top plate covers the entire trough area and the bottoms of the wells 25 are in close proximity of the bottom of the trough. Rivets 41 connect the top plate and the main plate through a number of mating holes 13 and 23, some holes remaining empty.

A rope heater III is positioned inside the trough 11 close to its side walls 19 and the end walls 15, starting at one end of the pocket 14 and ending at its opposite end. One heater end is connected through an insulated wire 34 to a thermostatic switch 35 and a thermo-fuse 36 positioned in the pocket 14. The rope heater is closer to the lateral posts 16 than to the central posts 26, in order to transmit a larger amount of heat energy from each stretch of heater to the outer posts, since the inner, central posts are heated on both sides by the two parallel heater stretches. The heater is kept in this position by the side walls of the wells 25 which urge it towards the sides. The heater also runs along the short walls 15 of the trough supplying extra heat energy to the outermost posts on both small sides which otherwise would not be heated sufficiently. In fact, by this arrangement heat output is largest at the ends and smallest in the center of the heater unit, thus obtaining an optimal heat distribution to all posts. The thermostat and the thermo-fuse are connected through an insulated wire 37 to switching and heat controlling means positioned in the outer casing of the set. The other end of the heater is connected to the same controlling means through an insulated wire 38, both wires 37 and 38 pass through a perforation III in the main plate I.

The rope heater is compressed in the trough by means of the top plate which is urged towards the trough bottom by the rivets 41. Owing to the arrangement of two lateral rows of posts on the main plate and one central row on the top plate, heat energy conveyed from the rope heater to the two plates is conducted to the posts without great heat losses to the surroundings, and no special heat insulation is required.

With a view to saving work and material the posts, in both the main plate and the top plate, are produced by deep drawing from aluminum sheeting. The main and the top plate are cut to measure and formed in dies, in either one or more operations, account being taken of the fact that the height of each post does not exceed $1\frac{1}{2}$ times its diameter. It is evident that this method of production is less costly than the hitherto known method of fastening separately manufactured posts into prefabricated holes in the metal plates by swaging. Heat transfer, in the present case, is better than with inserted posts, and it is highly important that only the central row of posts is heated via the top plate, and the two marginal rows via the main plate, thus obtaining an optimal and equal distribution of heat to all posts.

I claim:

1. A heater unit for a hair roller heating set composed of two heat-conductive sheet-metal components carrying at least three rows of upstanding hollow heating posts and enclosing between them electrical resistance heater means, the heater unit comprising: a main plate of generally rectangular configuration containing two lateral, parallel rows of said heating posts along the long edges of the rectangle, and being centrally recessed in the shape of a substantially rectangular trough of a depth commensurate with the thickness of said electrical heater means, said trough extending between the two rows of said lateral posts over substantially the entire length of said main plate; a top plate of rectangular configuration commensurate with the dimensions of said trough in said main plate, provided with at least one row of said hollow heating posts and rigidly attached to said main plate covering said trough; an electrical resistance heater in the form of an electrically insulated wire positioned along the four sides of said rectangle.

2. The heater unit of claim 1 wherein said trough in said main plate is bordered on its long sides by walls merging with the lateral sides of said main plate, and on its short sides by one upstanding wall each.

3. The heater unit of claim 1 wherein said top plate comprises one row of upstanding hollow posts, said posts being staggered with regard to said lateral heating posts on said main plate.

4. The heater unit of claim 3 wherein the central portion of said top plate is recessed to form shallow wells of a depth commensurate with the depth of said trough in said main plate, each of said wells being positioned between two adjoining posts and being perforated in its bottom portion by a hole.

5. The heater unit of claim 4 wherein the bottom of said trough in said main plate is perforated by holes corresponding in size and location to said holes in said wells in said top plate.

6. The heater unit of claim 5 wherein said main plate and said top plate are interconnected by connecting means, such as rivets, passing through said holes in said wells and in said trough, said connecting means serving to urge the opposed surfaces of said plates towards said electric heater means positioned in said trough.

7. The heater unit of claim 1, wherein the areas between adjoining posts of the two lateral rows on said main plate are cut away in order to reduce the amount of material to be preheated.

8. The heater unit of claim 1 wherein said electrical resistance heater means is in the form of a "rope heater", consisting of a fiberglass core wound with a fine resistance wire and covered by a sleeve of fiberglass serving as electrical insulation.

9. The heater unit of claim 8 wherein said rope heater is positioned in the space between said wells in said top plate and the outside walls of said trough in said main plate.

10. The heater unit of claim 8 wherein a downward extending pocket is provided in the center of one of the long sides of said rectangular trough, said pocket containing thermostatic switching means and fuse means connected to the ends of said rope heater, and to switching and temperature regulating means in said hair roller heating set.

* * * * *